US010643635B2

(12) United States Patent
Lin

(10) Patent No.: US 10,643,635 B2
(45) Date of Patent: May 5, 2020

(54) ELECTRONIC DEVICE AND METHOD FOR FILTERING ANTI-VOICE INTERFERENCE

(71) Applicant: NANNING FUGUI PRECISION INDUSTRIAL CO., LTD., Nanning (CN)

(72) Inventor: Yen-Hsin Lin, Shenzhen (CN)

(73) Assignee: NANNING FUGUI PRECISION INDUSTRIAL CO., LTD., Nanning (CN)

( * ) Notice: Subject to any disclaimer, the term of this patent is extended or adjusted under 35 U.S.C. 154(b) by 263 days.

(21) Appl. No.: 15/665,965

(22) Filed: Aug. 1, 2017

(65) Prior Publication Data

US 2018/0350386 A1 Dec. 6, 2018

(30) Foreign Application Priority Data

May 31, 2017 (CN) ..... 2017 1 0396430

(51) Int. Cl.

| | |
|---|---|
| ***G10L 25/84*** | (2013.01) |
| ***G10L 21/0224*** | (2013.01) |
| ***G10L 25/21*** | (2013.01) |
| ***G10L 21/0264*** | (2013.01) |
| ***G10L 21/0232*** | (2013.01) |
| ***G10L 25/51*** | (2013.01) |

(52) U.S. Cl.

CPC ..... *G10L 21/0264* (2013.01); *G10L 21/0224* (2013.01); *G10L 21/0232* (2013.01); *G10L 25/51* (2013.01); *G10L 25/84* (2013.01); *G10L 25/21* (2013.01)

(58) Field of Classification Search

CPC ..... G10L 25/21
USPC ..... 704/233
See application file for complete search history.

(56) References Cited

U.S. PATENT DOCUMENTS

| | | | | |
|---|---|---|---|---|
| 8,538,052 | B2 * | 9/2013 | Elmedyb | H04R 25/453 381/312 |
| 9,455,847 | B1 * | 9/2016 | Chung | H04L 25/03057 |
| 2002/0094043 | A1 * | 7/2002 | Chu | H04L 1/0054 375/346 |
| 2004/0161121 | A1 * | 8/2004 | Chol | G10L 21/0208 381/92 |

(Continued)

FOREIGN PATENT DOCUMENTS

| | | |
|---|---|---|
| CN | 1397062 | 2/2003 |
| CN | 102025852 A | 4/2011 |

*Primary Examiner* — Paras D Shah
*Assistant Examiner* — Timothy Nguyen
(74) *Attorney, Agent, or Firm* — ScienBiziP, P.C.

(57) ABSTRACT

An interference filtering method applied to the voice commands of a user of a device includes audio acquisition unit of device taking a first audio signal including user voice from the environment and a second audio signal from an audio output unit of a device creating competing noise. A first background audio signal is obtained by filtering a speech sound region in first audio signal, and a second background audio signal is obtained by filtering a speech sound region in second audio signal. A time difference T and a sound amplified parameter X are obtained by comparison. A third audio signal is obtained by performing time compensation, amplification, and an inverting operation on second audio signal. First audio signal and third audio signal are synthesized to produce fourth audio signal for feeding to voice recognition unit of the original user device.

12 Claims, 3 Drawing Sheets

(56) References Cited

U.S. PATENT DOCUMENTS

2011/0150257 A1* 6/2011 Jensen ..... H04R 25/453
381/318

* cited by examiner

ELECTRONIC DEVICE AND METHOD FOR FILTERING ANTI-VOICE INTERFERENCE

FIELD

The subject matter herein generally relates to device control technologies.

BACKGROUND

Electronic devices with a playback function (such as smart TV, computers, mobile phones, etc.) have various functions and complex options. Traditional control methods (such as remote control, touch control, mouse and keyboard control) cannot satisfy demands of users to conveniently operate the above electronic devices. Therefore, voice controls are developed.

However, voice commands can fail to control a target device, because the voice commands are seriously interfered with by noises, such as audio currently playing on the target device.

BRIEF DESCRIPTION OF THE DRAWINGS

Implementations of the present technology will now be described, by way of example only, with reference to the attached figures, wherein.

DETAILED DESCRIPTION

Figure 1:
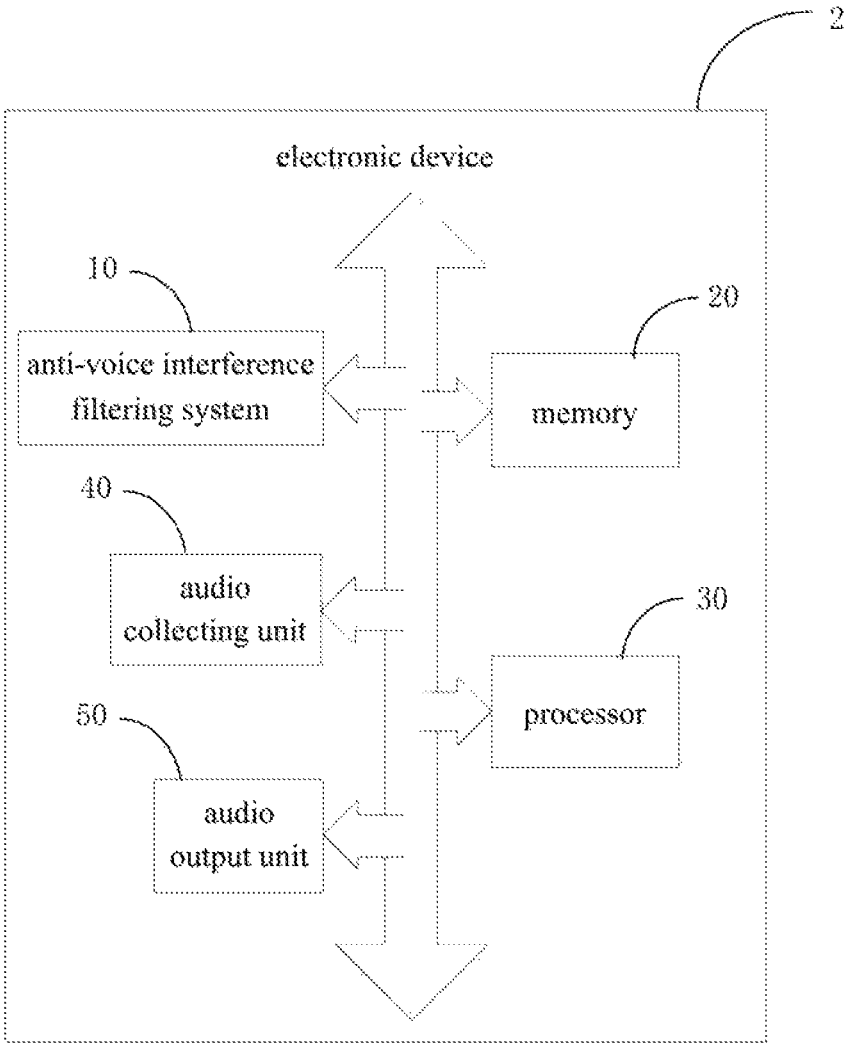
FIG. 1 is a diagram of an exemplary embodiment of an electronic device.

It will be appreciated that for simplicity and clarity of illustration, where appropriate, reference numerals have been repeated among the different figures to indicate corresponding or analogous elements. In addition, numerous specific details are set forth in order to provide a thorough understanding of an exemplary embodiment described herein. However, it will be understood by those of ordinary skill in the art an exemplary embodiments described herein can be practiced without these specific details. In other instances, methods, procedures, and components have not been described in detail so as not to obscure the related relevant feature being described. Also, the description is not to be considered as limiting the scope of an exemplary embodiments described herein. The drawings are not necessarily to scale and the proportions of certain parts may be exaggerated to better illustrate details and features of the present disclosure.

References to "an" or "one" embodiment in this disclosure are not necessarily to the same embodiment, and such references mean "at least one."

In general, the word "module" as used hereinafter, refers to logic embodied in computing or firmware, or to a collection of software instructions, written in a programming language, such as, Java, C, or assembly. One or more software instructions in the modules may be embedded in firmware, such as in an erasable programmable read only memory (EPROM). The modules described herein may be implemented as either software and/or computing modules and may be stored in any type of non-transitory computer-readable medium or other storage device. Some non-limiting examples of non-transitory computer-readable media include CDs, DVDs, BLU-RAY, flash memory, and hard disk drives. The term "comprising", when utilized, means "including, but not necessarily limited to"; it specifically indicates open-ended inclusion or membership in a so-described combination, group, series, and the like.

Referring to FIG. 1, an exemplary embodiment of an electronic device 2 includes an anti-voice interference filtering system 10, a memory 20, a processor 30, an audio collecting unit 40, and an audio output unit 50. In the present embodiment, the electronic device 2 may be a smart appliance, a smart phone, a computer, or the like.

The memory 20 includes at least one type of readable storage medium including flash memory, a hard disk, a multimedia card, a card type memory (e.g., SD or DX memory, etc.), a random access memory (RAM), static random access memory (SRAM), read only memory (ROM), electrically erasable programmable read only memory (EEPROM), programmable read only memory (PROM), magnetic memory, magnetic disks, optical disks, and the like. The processor 30 may be a central processing unit (CPU), a controller, a microcontroller, a microprocessor, or other data processing chip.

Figure 2:
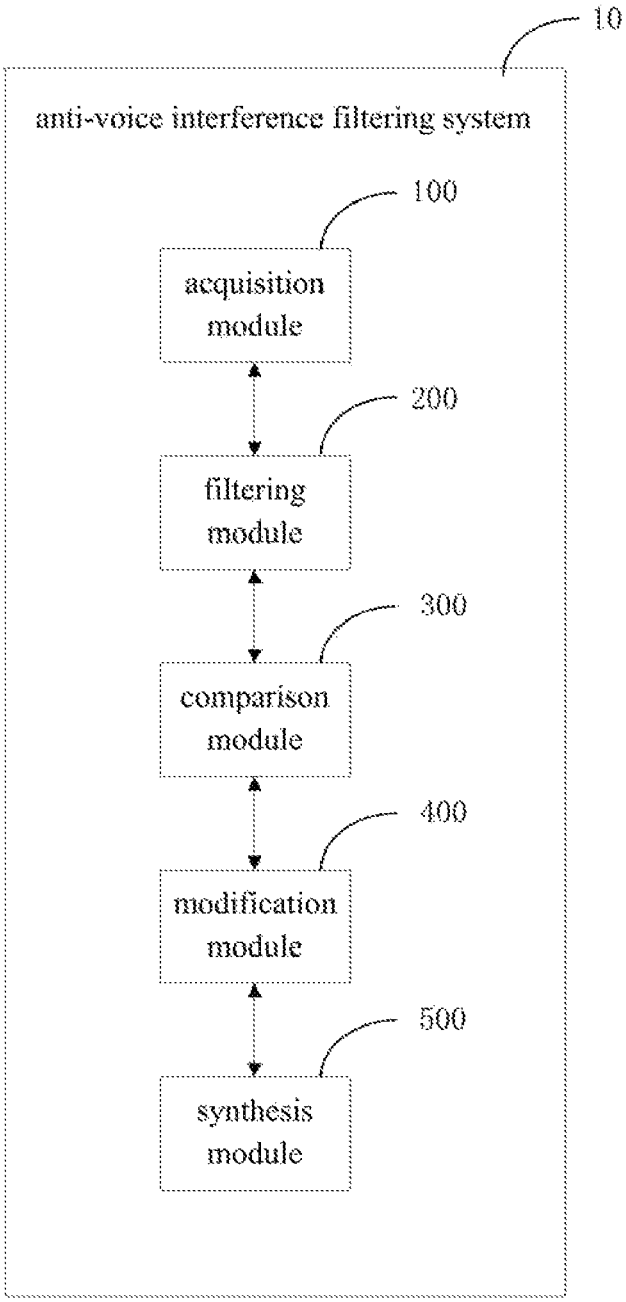
FIG. 2 is a block diagram of an exemplary embodiment of a filtering system for anti-voice interference.

FIG. 2 shows an exemplary embodiment of the system 10. The system 10 includes an acquisition module 100, a filtering module 200, a comparison module 300, a modification module 400, and a synthesis module 500. The modules are configured to be executed by one or more processors (the processor 30 in this embodiment). The memory 20 is used to store data such as program code of the system 10. The processor 30 is used to execute the program code stored in the memory 20.

The acquisition module 100 acquires, through the audio acquisition unit 40, a first audio signal from the environment, the first audio signal including a user voice signal.

The acquisition module 100 also acquires a second audio signal output from the audio output unit 50. In an embodiment, the second audio signal is taken from the inside of the electronic device 2, it is not taken from the surrounding environment.

The filtering module 200 filters a speech sound region in the first audio signal to obtain a first background audio signal, and filters a speech sound region in the second audio signal to obtain the second background audio signal. In this embodiment, speech sound region refers to a sound region corresponding to a normal human voice frequency, for example, an 80-1000 Hz region.

The comparison module 300 compares the first background audio signal with the second background audio signal to obtain a time difference T and a sound amplified parameter X between the first background audio signal and the second background audio signal.

In this embodiment, the comparison module 300 samples the first background audio signal to extract a first eigenvalue sequence of a plurality of sampling points in the first background audio signal, and samples the second background audio signal to extract a second eigenvalue sequence of a plurality of sampling points in the second background audio signal.

A method of calculating the first eigenvalue sequence and the second eigenvalue sequence comprises:

Setting a fixed interval as the time interval for calculating an energy value, the length of the fixed interval is t.

Continuously setting n fixed intervals with the interval length t at the same time points of the first background audio signal and the second background audio signal. In this embodiment, n=10 is taken as an example.

Obtaining a first interval energy sequence, E1[10]={$E1_1$, $E1_2$, . . . , $E1_{10}$}, by calculating the energy values of the 10 fixed intervals set in the first background audio signal. $E1_1$ is the energy value of the first fixed interval, $E1_2$ is the energy value of the second fixed interval, and so on.

Obtaining a second interval energy sequence, E2[10]={$E2_1$, $E2_2$,. . . $E2_{10}$}, by calculating the energy values of the 10 fixed intervals set in the first second background audio signal. $E2_1$ is the energy value of the first fixed interval, $E2_2$ is the energy value of the second fixed interval, and so on.

For the first background audio signal and the second background audio signal, each energy value in the fixed interval is compared with the energy value in the next fixed interval to obtain a first eigenvalue sequence C1[m] and a second eigenvalue sequence C2[m].

The eigenvalues are calculated as follows:

$$C_m = \begin{cases} 1 & \frac{E_{m+1}}{E_m} > 1.10 \\ 0 & 0.90 \le \frac{E_{m+1}}{E_m} \le 1.10 \\ -1 & \frac{E_{m+1}}{E_m} < 0.90 \end{cases}$$

Wherein $E_m$ is the energy value of the m-th fixed interval.

In this embodiment, the first eigenvalue sequence C1[9] and the second eigenvalue sequence C2[9] are calculated.

The comparison module 300 compares the first eigenvalue sequence C1[9] with the second eigenvalue sequence C2[9] to obtain a value k such that $C1_{m+k}=C2_m$. For example, if C1[9]={0,1,0,−1,1,1,1,0,0}, C2[9]={0,−1,1,1,1,0,0,1,0}, it can be seen that $C1_3=C2_1=0$, $C1_4=C2_2=-1$, . . . , $C1_9=C2_7=0$, so the value k is 2.

The time difference T is equal to the product of the interval length t and the value k.

The comparison module 300 also calculates the sound amplification parameter X based on the value k.

The calculation of the sound amplification parameter X is as follows:

$$X = \frac{\sum_{n=k+2}^{10} E1_n}{\sum_{n=2}^{10-k} E2_n}$$

Wherein $E1_n$ is the energy value of the n-th fixed interval in the first background audio signal, and $E2_n$ is the energy value of the n-th fixed interval in the second background audio signal.

In an embodiment, $E1_{10}$={3.7,3.8,6.0,5.9,3.8,5.0,5.6,6.5,7.1,7.4}, $E2_{10}$={5.0,4.9,3.2,4,4.7,5.4,5.9,6.2,6.8,7.3}, and k=2.

$$X = \frac{\sum_{n=4}^{10} E1_n}{\sum_{n=2}^{8} E2_n}$$

At this time, the sound amplification parameter X=1.1971.

The modification module 400 performs a time compensation operation, an amplification operation, and an inverting operation on the second audio signal, to obtain a third audio signal. The third audio signal is calculated as:

$$S_3(t)=-XS_2(t-T)$$

Wherein $S_3(t)$ is the third audio signal and $S_2(t)$ is the second audio signal.

The synthesis module 500 synthesizes the first audio signal and the third audio signal to obtain a fourth audio signal.

$$S_4(t)=S_1(t)+S_3(t)$$

Wherein $S_4(t)$ is the fourth audio signal, $S_1(t)$ is the first audio signal, and $S_3(t)$ is the third audio signal. In an embodiment, the fourth audio signal is a user voice from which the background noise has been filtered, and the fourth audio signal can be directly input to a voice recognition system of the electronic device 2.

Figure 3:
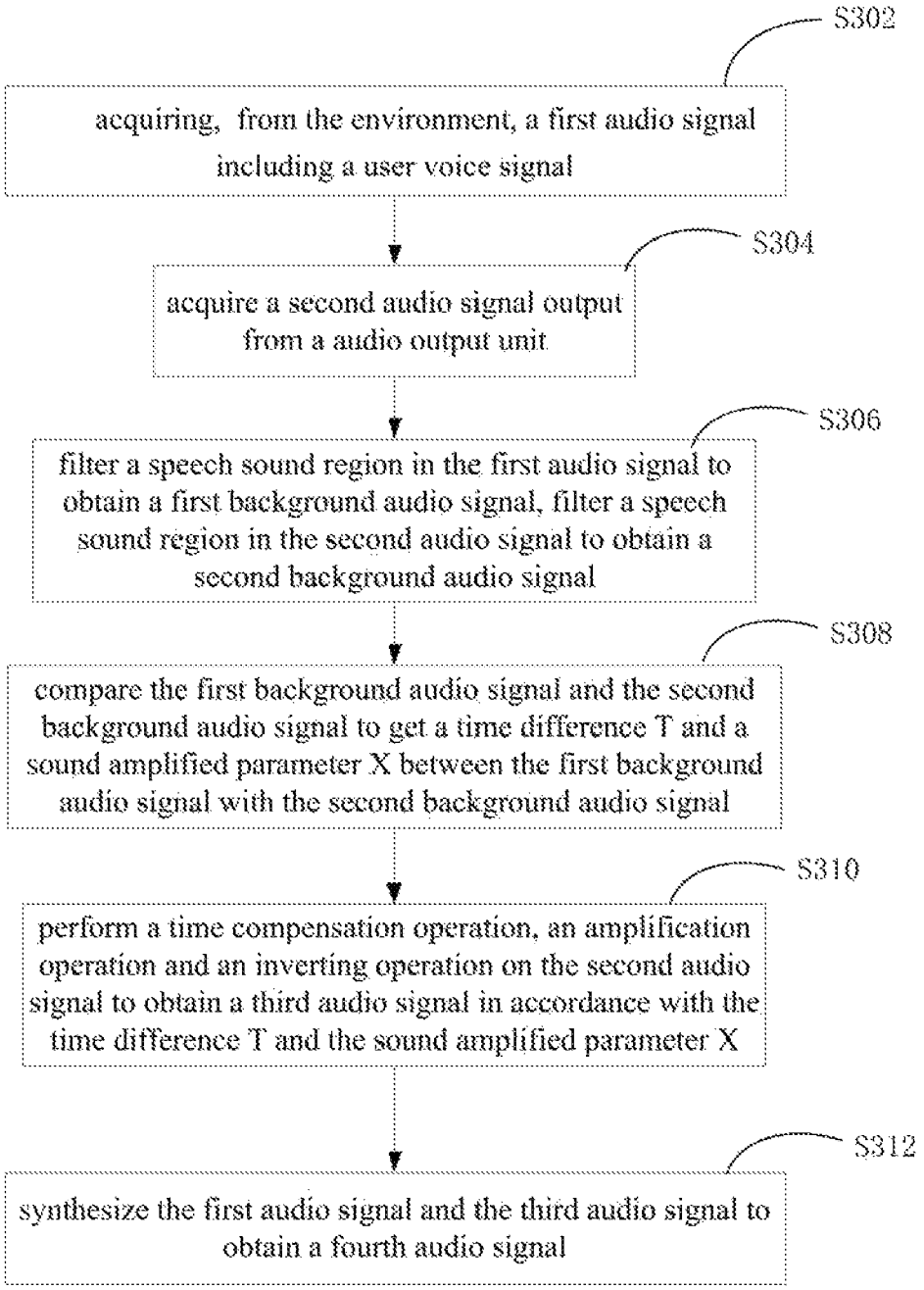
FIG. 3 is a flowchart of an exemplary embodiment of a voice interference filtering method.

FIG. 3 is a flowchart of an exemplary embodiment of a voice interference filtering method.

At block 302, a first audio signal including a user voice signal from the environment is acquired through an audio acquisition unit, wherein the first audio signal includes a user voice signal.

At block 304, a second audio signal is acquired from an audio output unit.

At block 306, a first background audio signal is obtained by filtering a speech sound region in the first audio signal and a second background audio signal is obtained by filtering a speech sound region in the second audio signal.

At block 308, a time difference T and a sound amplified parameter X are obtained by comparing the first background audio signal with the second background audio signal.

At block 310, a third audio signal is obtained by performing a time compensation operation, an amplification operation and an inverting operation on the second audio signal in accordance with the time difference T and the sound amplified parameter X.

At block 312, a fourth audio signal is obtained by synthesizing the first audio signal and the third audio signal.

It should be emphasized that the above-described embodiments of the present disclosure, including any particular embodiments, are merely possible examples of implementations, set forth for a clear understanding of the principles of the disclosure. Many variations and modifications can be made to the above-described embodiment(s) of the disclosure without departing substantially from the spirit and principles of the disclosure. All such modifications and variations are intended to be included within the scope of this disclosure and protected by the following claims.

What is claimed is:

1. An electronic device, comprising:

at least one processor;

a non-transitory storage medium coupled to the processor and configured to store one or more programs that are executed by the processor, the one or more programs comprises instructions for:

acquiring, from the environment, a first audio signal including a user voice signal;

acquiring a second audio signal output from an audio output unit;

filtering a speech sound region in the first audio signal to obtain a first background audio signal, and filtering the speech sound region in the second audio signal to obtain a second background audio signal;

comparing the first background audio signal with the second background audio signal to obtain a time difference T and a sound amplification parameter X between the first background audio signal and the second background audio signal;

performing a time compensation operation, an amplification operation and an inverting operation on the second audio signal to obtain a third audio signal according to the time difference T and the sound amplified parameter X; and synthesizing the first audio signal and the third audio signal to obtain a fourth audio signal;

extracting a first eigenvalue sequence consisting of multiple first eigenvalues corresponding to multiple sampling points in the first background audio signal, and extracting a second eigenvalue sequence consisting of multiple second eigenvalues corresponding to multiple sampling points in the second background audio signal;

calculating the time difference T between the first background audio signal and the second background audio signal based on the first eigenvalue sequence and the second eigenvalue sequence;

compensating the second background audio signal based on the time difference T; and comparing the compensated second background audio signal with the first background audio signal to obtain the sound amplification parameter X.

2. The electronic device as claimed in claim 1, wherein the one or more programs further comprise instructions for:

setting a time interval t for calculating an energy value;

setting, based on a same starting point, n consecutive time intervals in the first background audio signal and in the second background audio signal;

obtaining a first interval energy sequence E1[n] by calculating energy values of the n consecutive time intervals in the first background audio signal;

obtaining a second interval energy sequence E2[n] by calculating energy values of the n consecutive time intervals in the second background audio signal;

obtaining a first eigenvalue sequence C1[m] by comparing each energy value in the first interval energy sequence with a next adjacent energy value in the first interval energy sequence;

obtaining a second eigenvalue sequence C2[m] by comparing each energy value in the second interval energy sequence with a next adjacent energy value in the second interval energy sequence.

3. The electronic device as claimed in claim 2, wherein an eigenvalue $C_m$ is calculated through a formula as following:

$$C_m = \begin{cases} 1 & \frac{E_{m+1}}{E_m} > 1.10 \\ 0 & 0.90 \le \frac{E_{m+1}}{E_m} \le 1.10 \\ -1 & \frac{E_{m+1}}{E_m} < 0.90 \end{cases}$$

wherein $E_m$ is the energy value of the m-th fixed interval.

4. The electronic device as claimed in claim 2, wherein and the one or more programs further comprise instructions for:

comparing the first eigenvalue sequence C1[m] with the second eigenvalue sequence C2[m] to obtain a value k, wherein $C1_{m+k}=C2_m$;

the time difference T is equal to a product of the time interval t and the value k.

5. The electronic device as claimed in claim 4, wherein the sound amplification parameter X is calculated through a formula as following:

$$X = \frac{\sum_{n=k+2}^{10} E1_n}{\sum_{n=2}^{10-k} E2_n}$$

wherein $E1_n$ is a energy value of the n-th time interval in the first background audio signal, and $E2_n$ is a energy value in the n-th time interval of the second background audio signal.

6. The electronic device as claimed in claim 1, wherein the third audio signal is calculated through a formula as following:

$$S_3(t)=-XS_2(t-T)$$

wherein $S_3(t)$, is the third audio signal, $S_2(t)$ is the second audio signal.

7. A voice interference filtering method, the method comprising:

acquiring, from the environment, a first audio signal including a user voice signal;

acquiring a second audio signal output from an audio output unit;

filtering a speech sound region in the first audio signal to obtain a first background audio signal, and filtering the speech sound region in the second audio signal to obtain a second background audio signal;

comparing the first background audio signal with the second background audio signal to obtain a time difference T and a sound amplified parameter X between the first background audio signal and the second background audio signal;

performing a time compensation operation, an amplification operation and an inverting operation on the second audio signal to obtain a third audio signal according to the time difference T and the sound amplified parameter X; and synthesizing the first audio signal and the third audio signal to obtain a fourth audio signal;

extracting a first eigenvalue sequence consisting of multiple first eigenvalues corresponding to multiple sampling points in the first background audio signal, and extracting a second eigenvalue sequence consisting of multiple second eigenvalues corresponding to multiple sampling points in the second background audio signal;

calculating the time difference T between the first background audio signal and the second background audio signal based on the first eigenvalue sequence and the second eigenvalue sequence; and compensating the second background audio signal based on the time difference T; and comparing the compensated second background audio signal with the first background audio signal to obtain the sound amplified parameter X.

8. The voice interference filtering method as claimed in claim 7, the method further comprising:

setting a time interval t for calculating an energy value;

setting, based on a same starting point, n consecutive time intervals in the first background audio signal and in the second background audio signal;

obtaining a first interval energy sequence $E_1[n]$ by calculating energy values of the n consecutive time intervals in the first background audio signal;

obtaining a second interval energy sequence $E_2[n]$ by calculating energy values of the n consecutive time intervals in the second background audio signal;

obtaining a first eigenvalue sequence C1[m] by comparing each energy value in the first interval energy sequence with a next adjacent energy value in the first interval energy sequence; and obtaining a second eigenvalue sequence C2[m] by comparing each energy value in the second interval energy sequence with a next adjacent energy value in the second interval energy sequence.

9. The voice interference filtering method as claimed in claim 8, wherein an eigenvalue $C_m$ is calculated through a formula as following:

$$C_m = \begin{cases} 1 & \frac{E_{m+1}}{E_m} > 1.10 \\ 0 & 0.90 \le \frac{E_{m+1}}{E_m} \le 1.10 \\ -1 & \frac{E_{m+1}}{E_m} < 0.90 \end{cases}$$

wherein $E_m$ is the energy value of the m-th fixed interval.

10. The voice interference filtering method as claimed in claim 8, the method further comprising:

comparing the first eigenvalue sequence C1[m] with the second eigenvalue sequence C2[m] to obtain a value k, wherein $C1_{m+k}=C2_m$;

the time difference T is equal to a product of the time interval t and the value k.

11. The voice interference filtering method as claimed in claim 10, wherein the sound amplified parameter X is calculated through a formula as following:

$$X = \frac{\sum_{n=k+2}^{10} E1_n}{\sum_{n=2}^{10-k} E2_n}$$

wherein $E1_n$ is a energy value of the n-th tine interval in the first background audio signal, and $E2_n$ is a energy value in the n-th time interval of the second background audio signal.

12. The voice interference filtering method as claimed in claim 7, wherein the third audio signal is calculated through a formula as following:

$$S_3(t)=-XS_2(t-T)$$

wherein $S_3(t)$ is the third audio signal, $S_2(t)$ is the second audio signal.

* * * * *